US006728986B2

(12) United States Patent
Williams

(10) Patent No.: US 6,728,986 B2
(45) Date of Patent: May 4, 2004

(54) BODY SUPPORT ARRANGEMENTS

(75) Inventor: David Mark Williams, Derby (GB)

(73) Assignee: Siddall & Hilton Limited (GB)

( * ) Notice: Subject to any disclaimer, the term of this patent is extended or adjusted under 35 U.S.C. 154(b) by 0 days.

(21) Appl. No.: 10/407,704

(22) Filed: Apr. 4, 2003

(65) Prior Publication Data

US 2003/0182729 A1 Oct. 2, 2003

Related U.S. Application Data

(63) Continuation-in-part of application No. 10/003,870, filed on Oct. 24, 2001, now abandoned.

(30) Foreign Application Priority Data

Oct. 28, 2000 (GB) ..... 0026404

(51) Int. Cl.[7] ..... A47C 27/20
(52) U.S. Cl. ..... 5/716; 5/718
(58) Field of Search ..... 5/716, 718, 720, 5/247, 253, 255, 655.7, 655.8, 722, 723, 727; 267/95

(56) References Cited

U.S. PATENT DOCUMENTS

| | | | | |
|---|---|---|---|---|
| 2,925,856 A | 2/1960 | Gleason | ..... | 5/718 X |
| 3,099,021 A | 7/1963 | Wetzler | ..... | 5/718 |

(List continued on next page.)

FOREIGN PATENT DOCUMENTS

| | | | | |
|---|---|---|---|---|
| AU | 239470 B | * 11/1960 | ..... | 5/723 |
| DE | 3842211 A1 | * 6/1990 | ..... | 5/720 |
| EP | 180244 | * 5/1986 | ..... | 5/716 |
| GB | 759177 A | * 10/1956 | ..... | 5/722 |

*Primary Examiner*—Robert G. Santos
(74) *Attorney, Agent, or Firm*—Trexler, Bushnell, Giangiorgi, Blackstone & Marr, LTD

(57) ABSTRACT

Conventional beds have a spring mattress and a sprung base for the comfort of the user, but on profiling beds, a sprung base cannot be used and, ordinarily, a mattress is laid on lifting and lowering mechanism, with a result that when pivoted or folded, folding or rucking of the surface of the mattress occurs to the discomfort of the user. A first object of the invention is to avoid the above disadvantage, and a second object is to provide a body support arrangement of greater comfort than conventional mattresses and separate bases.

The first objective is met by a body support arrangement comprising at least two sectors connected in such a manner as to permit a relative pivoting of the sectors with respect to each other, each sector being formed by an upper sprung or filled mattress part and lower sprung base part. Preferably, the body support arrangement comprises three sectors, each sector being hingedly connected to an adjacent sector, to allow each sector to be so angularly positioned to suit a users required body and leg dispositions. At the pivot area between the mattress parts of the sectors, a filling of a resilient and compressible material may be provided between the springs. The second objective is met by a construction comprising an array of springs, extending between upper and lower surfaces of the support arrangement in spaced relationship in the longitudinal and transverse directions, the spaces between at least some of the springs being filled with resilient and compressible material. The filling preferably extends over the full length and width of the arrangement, and further, preferably, is in upper and lower layers with through holes into which extend the upper and lower ends of the springs respectively.

11 Claims, 6 Drawing Sheets

U.S. PATENT DOCUMENTS

| | | | | | |
|---|---|---|---|---|---|
| 3,594,833 | A | | 7/1971 | Richter | 5/1 |
| 4,052,760 | A | * | 10/1977 | Golembeck et al. | 5/248 |
| 4,161,046 | A | * | 7/1979 | Golembeck | 5/716 X |
| 4,485,506 | A | | 12/1984 | Stumpf et al. | 5/655.8 |
| 4,662,011 | A | * | 5/1987 | Duvivier | 5/716 |
| 4,677,701 | A | | 7/1987 | Galumbeck | 5/722 |
| 4,679,266 | A | * | 7/1987 | Kraft | 5/716 |
| 4,907,309 | A | | 3/1990 | Breckle | 5/720 |
| 5,048,167 | A | | 9/1991 | Heffley et al. | 29/91.1 |
| 5,239,715 | A | | 8/1993 | Wagner | 5/719 X |
| 5,467,488 | A | | 11/1995 | Wagner | 5/716 |
| 5,469,590 | A | | 11/1995 | Simon | 5/253 X |
| 5,687,439 | A | | 11/1997 | Wagner | 5/718 X |
| 5,832,551 | A | | 11/1998 | Wagner | 5/718 |
| 5,868,383 | A | * | 2/1999 | Codos | 5/720 X |
| 5,885,407 | A | | 3/1999 | Mossbeck | 156/558 |
| 5,953,778 | A | * | 9/1999 | Hiatt | 5/716 |
| 5,987,678 | A | * | 11/1999 | Ayers | 5/720 |
| 6,023,803 | A | | 2/2000 | Barman | 5/716 |
| 6,128,798 | A | * | 10/2000 | Barman et al. | 5/716 |
| 6,295,676 | B1 | * | 10/2001 | Warner | 5/720 |
| 6,318,416 | B1 | * | 11/2001 | Grueninger | 5/716 X |
| 6,484,338 | B1 | * | 11/2002 | Hagglund | 5/716 |
| 2002/0078509 | A1 | * | 6/2002 | Williams | 5/716 |
| 2003/0182729 | A1 | * | 10/2003 | Williams | 5/718 |

* cited by examiner

BODY SUPPORT ARRANGEMENTS

This invention relates to body support arrangements, particularly for beds.

Ordinarily, beds have a body support arrangement formed by a base overlaid by a mattress, and there has evolved a considerable variety of spring or filled mattresses, the spring arrangements or the fillings such as foam rubber being such as to offer a wide variety of firm to soft mattresses to suit a potential user.

Whilst mattresses can be laid on a firm, unyielding base, it has long been recognised that a greater degree of comfort can be provided to the user if the base itself is sprung, by a spring arrangement that has its own characteristics to add to or complement the spring or filled mattress.

Conventional beds for normal use are formed by a sprung base with a horizontal surface on which the mattress is laid. However, when it comes to beds for users with a need or a preference to use a bed other than flat, sections of the bed are frequently required to be raised or lowered, such as, for example, to raise the upper body to an approximate sitting position, or to raise or bend the legs.

Conventional beds are not conducive to this. The presence of a spring base impedes the correct location of lifting and lowering mechanism for the mattress, and if such mechanism is applied solely to the mattress, an attempt to lift a section of it would simply result in the mattress bending or folding and cause rucking on its surface such as to render it unuseable.

To combat this, the common practise is to dispense with a sprung base and to lie the mattress on a rigid platform, sections of which can be lifted and lowered to cause sections of mattress to assume a required disposition to suit the needs or the requirements of a user, but at the expense of detracting from the total comfort and support available in conventional beds.

A further factor when conventional mattresses are laid on a rigid platform with adjustable sections, is that when one section is pivotally attached to an adjacent section and adjusted from an in-line condition to a condition where the included angle between the said sections is less than 180°, a fold, more a number of folds are caused in the upper surface of the mattress, to the noticeable discomfort of the user, and an increased risk of the creation of bed sores when the person using the bed must, due to a medical condition, lie on it for considerable periods.

The object of the invention is to provide a body support arrangement that avoids the disadvantages mentioned above.

According to the present invention, a body support arrangement comprises an array of springs extending between the upper and lower outer surfaces of a generally rectangular piece of a resilient and compressible material, the springs lying in passageways through the thickness of the resilient material, which passageways have one dimension substantially equal to the diameter of the springs, and a dimension perpendicular thereto greater than that of the diameter of the springs, the material of the generally rectangular piece substantially filling the spaces between a majority of the springs. The resilient and compressible material may be a foam rubber.

Preferably the resilient and compressible material is in two layers, upper and lower, with co-operating passageways to receive the upper and lower ends of the springs, and the spaces between the springs being filled by separate pieces of the same or compatible resilient and compressible material. Whilst the filling may be by separate pieces, equally, said filling may be a lattice of a size equating to that of the upper and lower layers.

By matching the ratings of the springs to the compressibility of the resilient and compressible materials, a body support arrangement of any required firmness or softness to suit a user, can be provided.

Preferably the resilient and compressible material is so structured as to have different degrees of resilience and compressibility towards the outer upper and lower surfaces of the support means to simulate conventional upper and lower mattress and base parts, by having a graduated degree of resilience and compressibility across the thickness of the layer of resilient and compressible material, or desirably by providing upper and lower layers of resilient and compressible material, with each layer having a required degree of resilience and compressibility.

Where the requirement is for a conventional and continuous mattress, a combination of spaced springs and resilient and compressible filling can extend over the full width and length of a body support arrangement, and the softness/firmness of it can be constant over its full width and length. However, by selection of different springs and different resilient and compressible materials, and strategically positioning them across the width and over the length of the body support, it can be tailored to suit the particular requirements of the user, by creating zones of required softness and firmness.

To provide the required passageways through the resilient and compressible material, or the co-operating passageways through upper and lower layers of resilient and compressible material, it or they may have an initial width less than that required, and be provided with a number of cuts or slots of a length greater than that of the spring diameters, and transversely stretched to create oval passageways to receive the springs, of one (lateral) dimension equal to that of the spring diameters and a second (longitudinal) dimension greater than that of the spring diameters. With the springs inserted in the passageways, the or each layer of resilient material is held with a required transverse dimension, with free spaces to opposite sides of the springs in the longitudinal direction.

Whilst cuts or slots can allow the production of passageways, it is preferred that punched holes of an elongate narrow oval shape are formed through the or each piece to be stretched into the larger oval holes to receive the springs.

When used in conjunction with a suitable profiling support structure, on or within which is located appropriate mechanisms to lift and lower sectors of the support structure, a body support arrangement in accordance with the second embodiment, by having spaced springs and a resilient and compressible material, at least across the width of the arrangement at the position where one section is intended to pivot or bend in relation to an adjacent section, a smooth transition is provided between adjacent sectors set at different angular inclinations, free from any folding or rucking of the upper surface of the arrangement, to the considerable benefit of the user. This is largely consequential on the presence of free spaces to both sides of the springs in the longitudinal direction taking up the compression of the resilient material at the upper outer surface as it is caused to curve by the adjustment of the platforms.

Whilst spaced springs and fillings of resilient and compressible material can be provided over the full width and length of a body support arrangement intended for use with a profiling support structure, individual sectors of a body support arrangement in accordance with the invention, can be devoid of spaced springs and formed by the filling of resilient and compressible material.

For ease of manufacture, the springs for the invention may be relatively conventional pocketed springs, but with adjacent springs in each longitudinal row of greater than conventional pitch, and with the springs in one longitudinal row offset in relation to the springs in the immediately adjacent row. This generates a circumstance where the array of springs generates a triangular distribution with adequate space between adjacent springs to allow for spring movement without there being contact between adjacent springs. To provide added strength at the outer edges of the body support arrangement, an outer row of springs can be of greater compressive strength than elsewhere across the mattress, or a row of closely spaced springs of the same strength can be provided. Equally possible is the provision of an outer edge of resilient and compressible material of greater firmness than elsewhere across the body support arrangement.

With a body support arrangement of the invention, it has the capability of serving as a conventional mattress and sprung base arrangement and, additionally, as a mattress for use on an adjustable bed with an enhancement of those desirable characteristics of conventional beds, and the complete elimination of rucking at its surface.

Several embodiments of the invention will now be described with reference to the accompanying drawings, in which.

Figure 1:
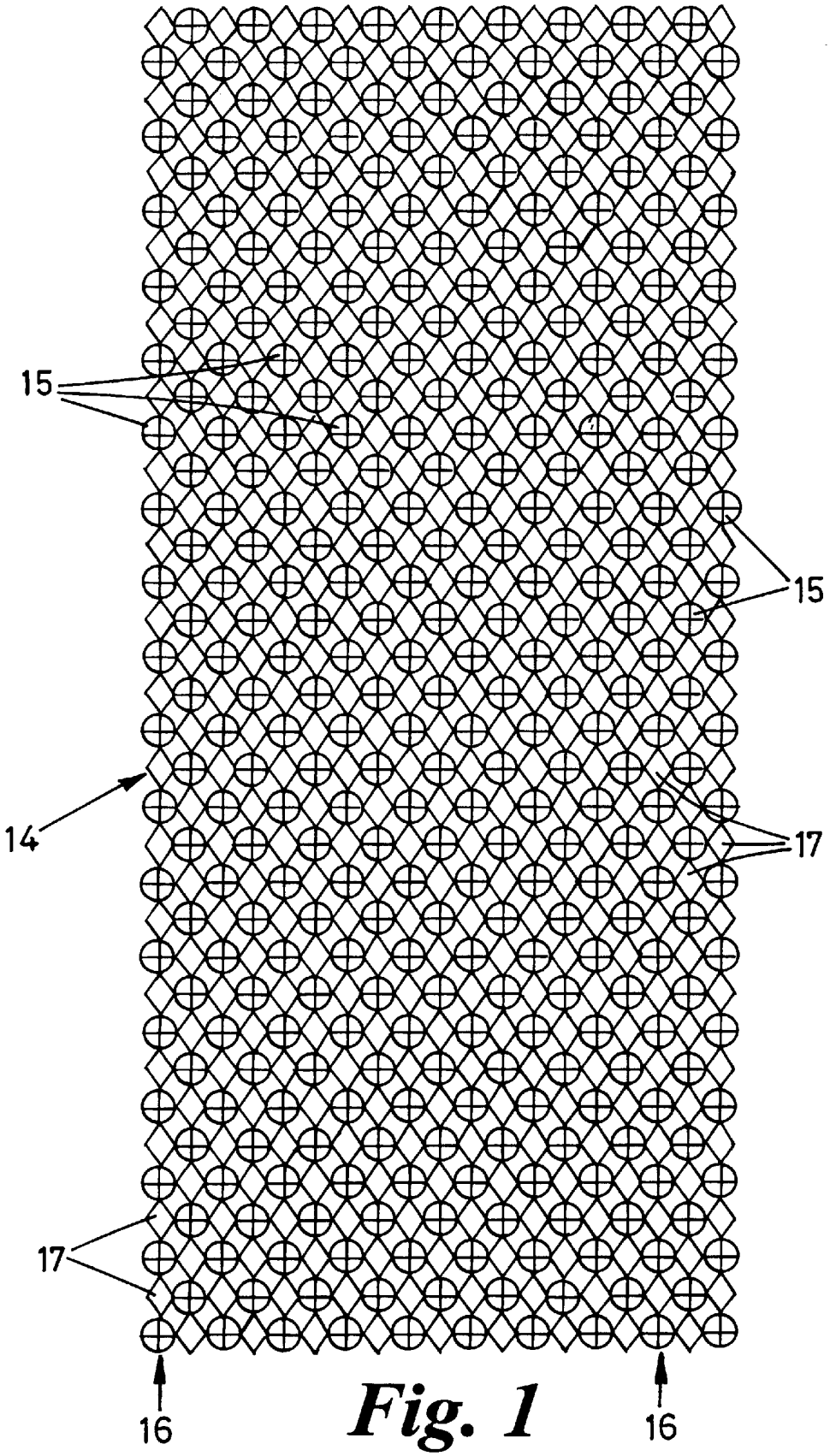
FIG. 1 is a plan view of a support arrangement in accordance with the invention.
Figure 2:
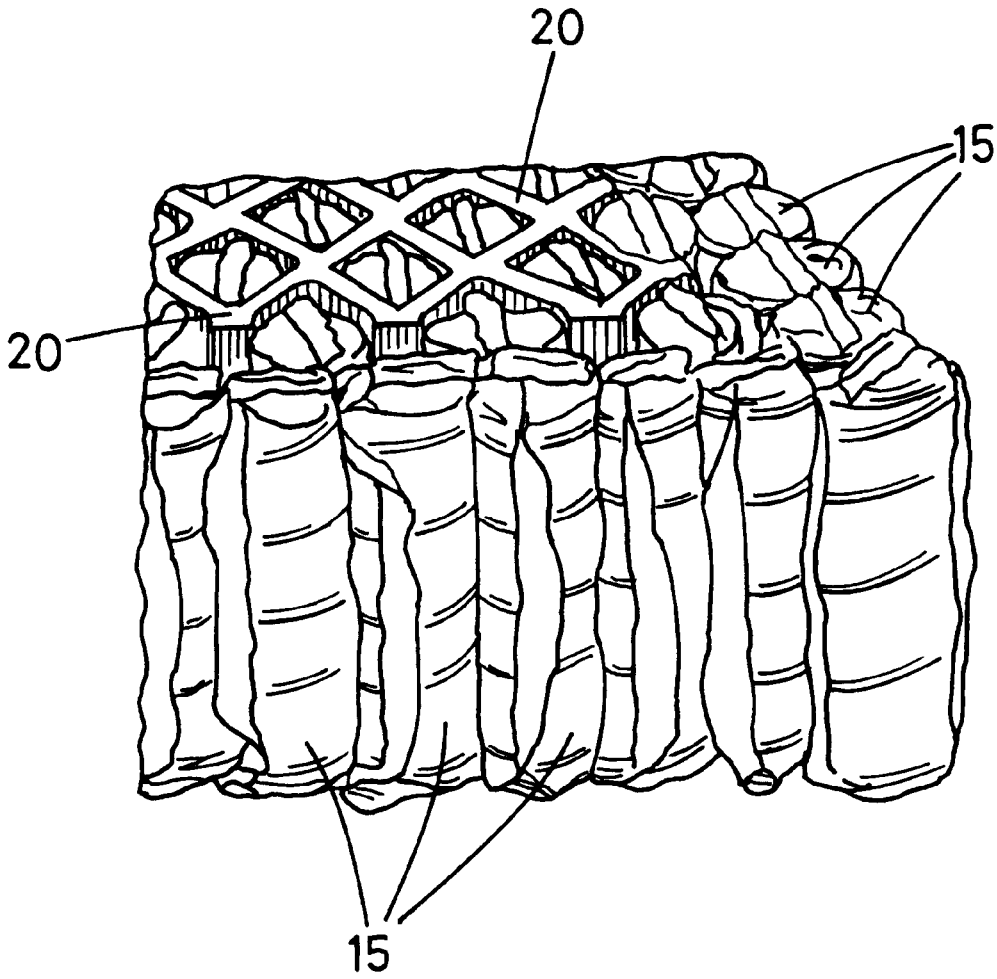
FIG. 2 is a perspective view of part of the support arrangement of FIG. 1.

In FIGS. 1 to 8 a body support arrangement 14 is in the form of a mattress for a bed. Here, relatively conventional, so-called pocketed springs 15 are provided, of a height to extend between the outer upper and lower surfaces of the body support arrangement. As is shown in FIG. 1 the pocketed springs are in lengthwise rows 16, but unlike conventional pocketed springs, springs are of greater pitch to leave gaps 17, and in adjacent lengthwise rows, the springs and gaps are offset, such as to have a spring 15 of one row laterally aligned with a gap 17 in the adjacent row. As is shown by FIG. 2, complete longitudinal and lateral rows of pocketed springs can be provided at the lateral and lengthwise sides, to provide edge strength.

Figure 3:
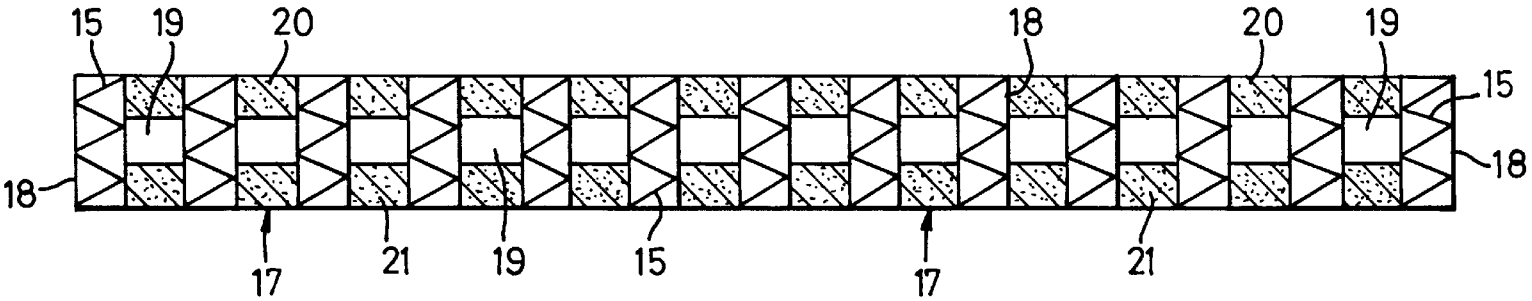
FIG. 3 is a schematic sectional side elevation of the support arrangement of FIG. 1.
Figure 4:
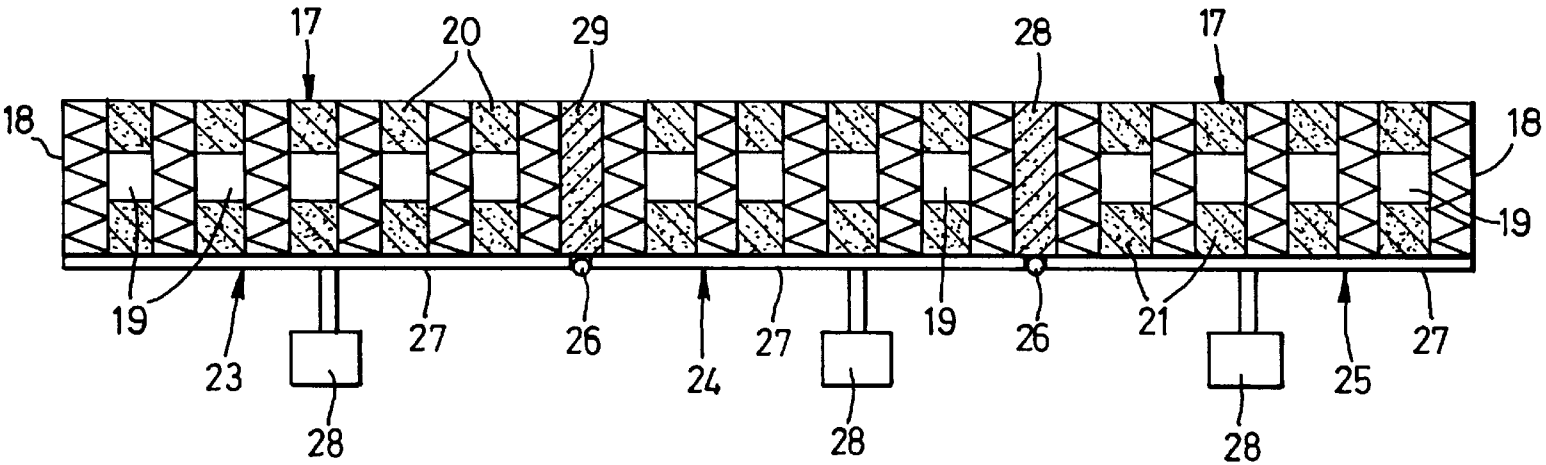
FIG. 4 is a schematic sectional side elevation of a second form of support arrangement according to the invention.
Figure 5:
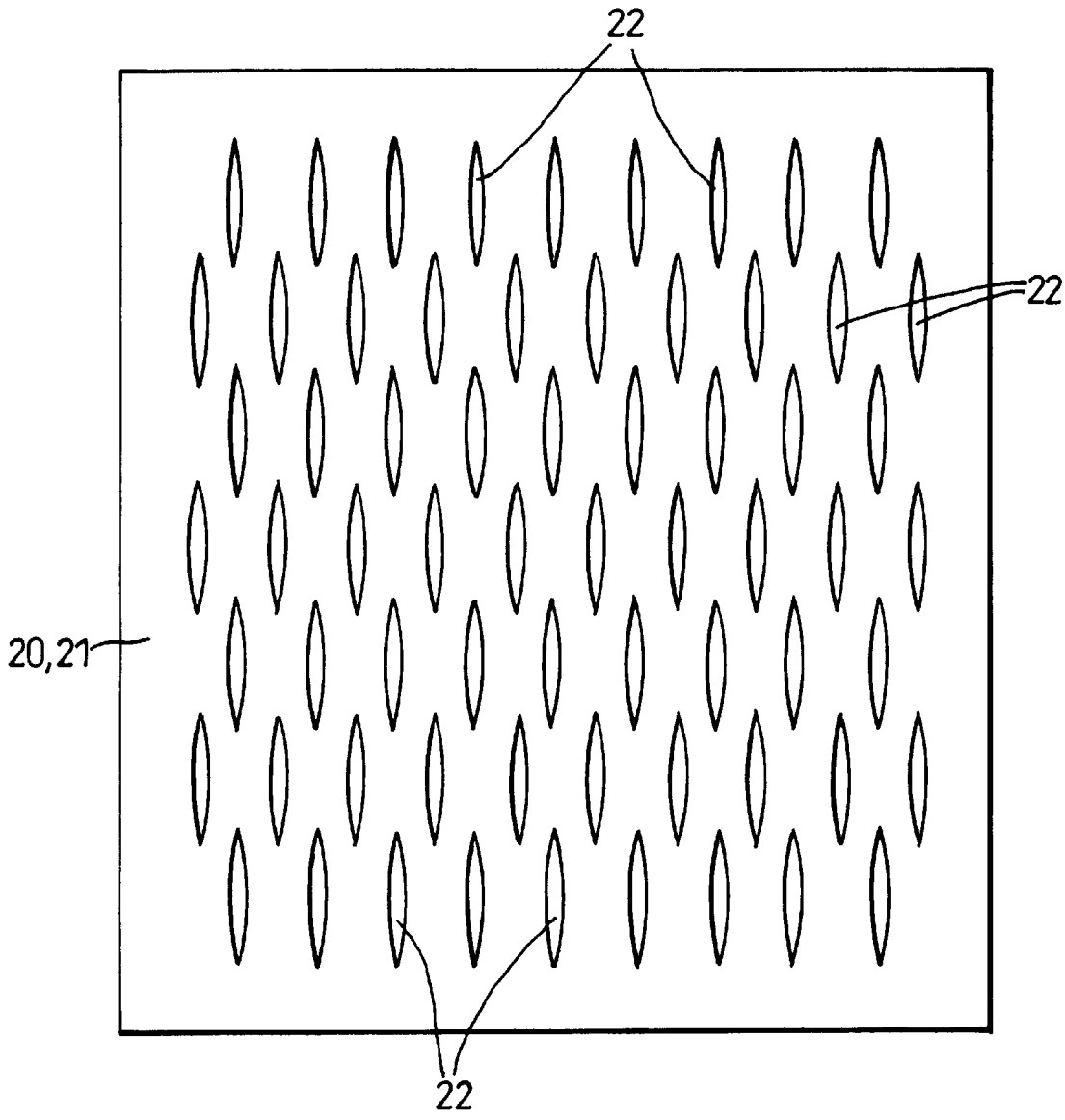
FIG. 5 is a plan view of resilient and compressible material for use in the support arrangement of FIG. 3 or FIG. 4, displaying punched oval holes.

As is illustrated in FIGS. 3 and 4, the fabric 18 of the pocketed springs, in the gap 17 between adjacent springs is cut at its upper and lower edges to leave a tie 19 between adjacent springs, and the gap 17 above and below the tie are filled with a resilient and compressible material 20, 21 such as a foam rubber. For ease of manufacture and assembly, the upper and lower fillers may each be formed as a single sheet 20, 21 of a requisite length and width, and punched with oval slots as is indicated at 22 in FIG. 5. Thus, when the punched material is stretched, through passageways are created of a size to accommodate the upper or the lower end of a pocketed spring.

The selection of the particular grade of resilient and compressible material for the upper layer 20 may be such as to provide, in combination with the springs, a comfort layer, and the selection for the lower layer 21 may be such that it combines with the springs to provide a support layer, and when the combination of upper and lower parts of the body support arrangement allow it to serve as a conventional mattresses and base, but with the provision of a greater degree of comfort for the user, that can be achieved with conventional spring or filled mattresses and bases.

A still further advantage of this embodiment of the invention is that the upper layer 20 in particular and possible the lower layer 21 need not be of one consistency over the width and length of the bed, and the springs need not be of a single rating. Thus, areas of the bed can be determined, and different grades of e.g. foam rubber used selectively, and springs of different ratings used selectively over the area of the body support arrangement, to provide levels of softness and firmness to suit a users particular requirements.

The construction of the body support arrangement of FIGS. 1 to 5, by virtue of the provision of gaps between springs and e.g. foam rubber fillings, allows it to be used flat and as a conventional bed. However, a body support arrangement in accordance with the invention can be laid on the lifting and lowering mechanisms of a profiling bed, to cause sectors 23, 24 and 25 of the support arrangement to be set at required angular dispositions to adjacent sectors, adjacent sectors effectively pivoting about a motional pivot centrally of the construction, with a smooth curved transition free from folding and rucking, as is indicated schematically in FIG. 4.

As is illustrated schematically in FIG. 4, the body support arrangement of the invention can have a defined pivot area by removing all springs in a transverse line across the support arrangement, and to have a pivot 26 at the junctions of support plates 27 to which drive mechanisms 28 are attached. These transverse lines across the width serve as transitional zones and can be filled with resilient and compressible material as is indicated at 29. Here again, the arrangement can be used flat and conventionally, or as a profiling bed, as may be required.

Figure 6:
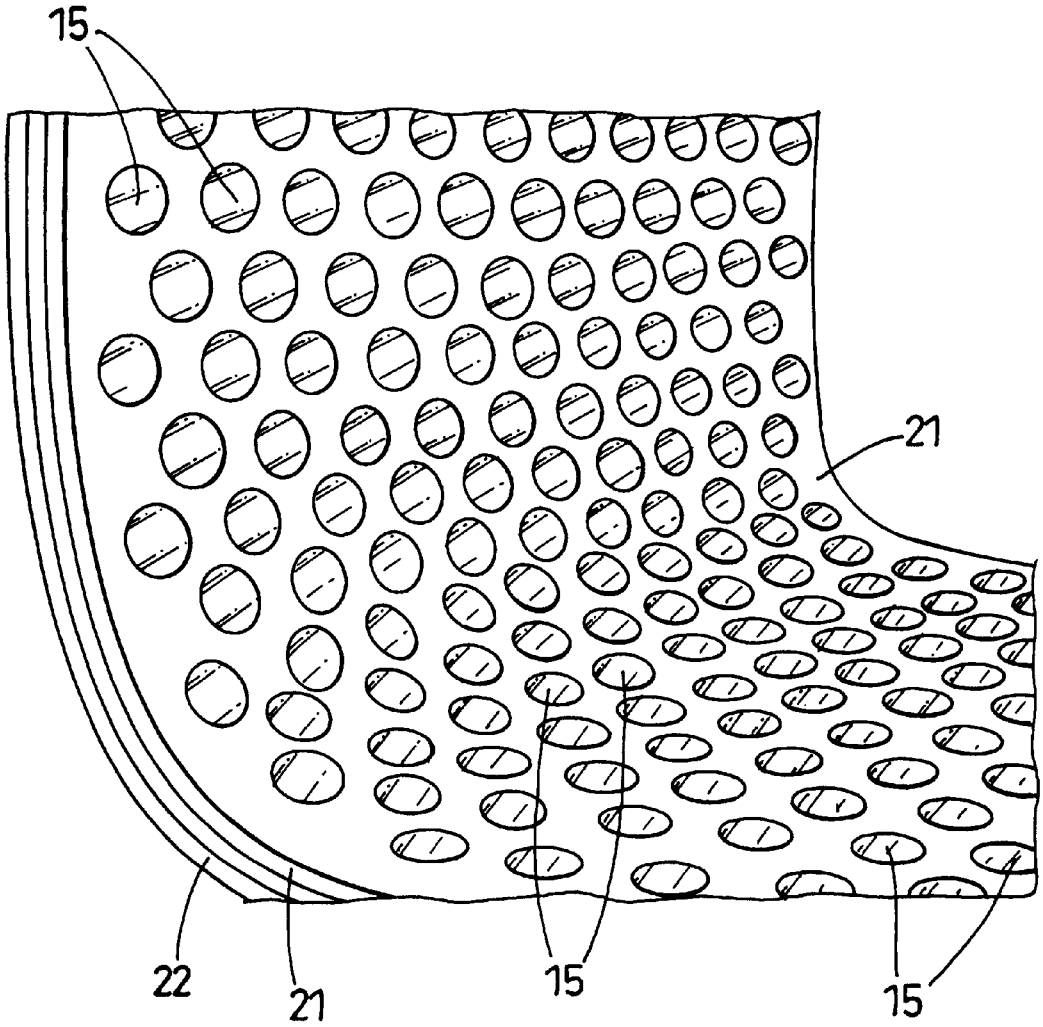
FIG. 6 is a schematic perspective view of a support arrangement of the invention folded to a 90° disposition.

When used on a profiling bed, and with one section raised with respect to an adjacent section to set the sections at less than 180° the effect of the provision of oval slots is to ensure that the upper surface of the mattress assumes a totally smooth curve, free from folding or rucking, which smooth curve is maintained even when the mattress is set with one part at 90° to an adjacent part, as is illustrated in FIG. 6.

Figure 7:
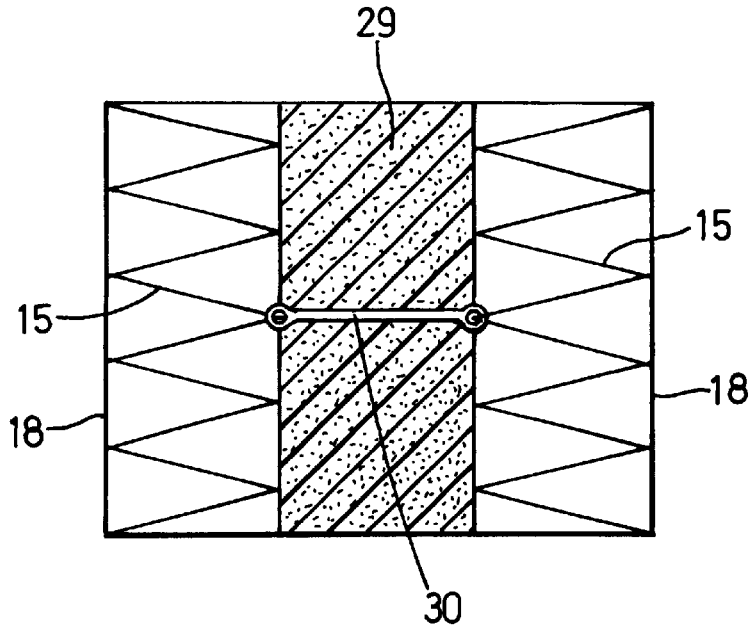
FIGS. 7 and 8 are elevations of clip means able to hold the springs of the support arrangement in a required side-by-side disposition.
Figure 8:
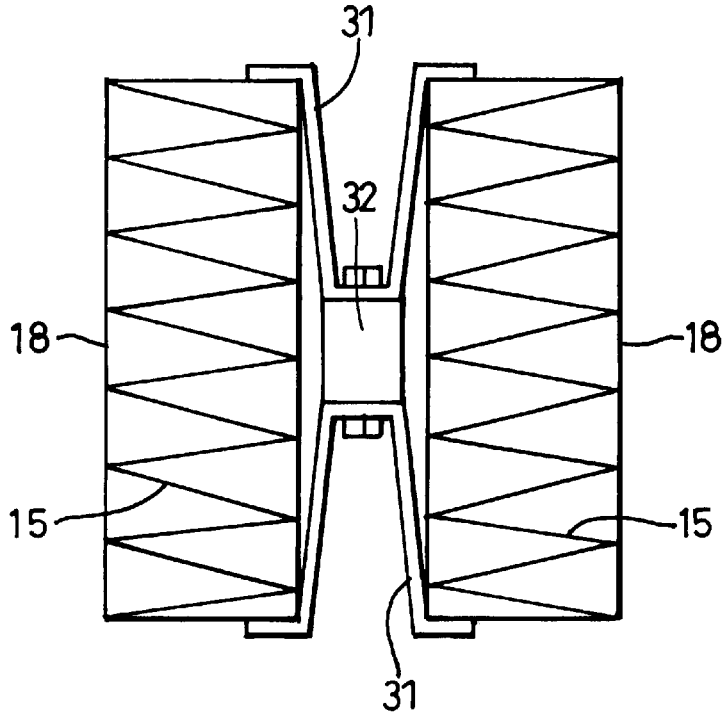

To have a pivotal action at the approximate mid-plane of the body support arrangement, an attachment means can be provided between adjacent springs. Thus, as is illustrated in FIG. 7, a member 30 can extend between adjacent springs and cause the springs to pivot with respect to each other at their centre plane. Alternatively, as is shown in FIG. 8, generally U-shaped spring clips 31 can be provided mounted on opposite sides of a support 32, that without load will hold adjacent springs in a parallel disposition, but will allow one spring to pivot with respect to the adjacent spring about the central support 31.

What is claimed is:

1. A body support arrangement comprising an array of springs extending between the upper and lower outer surfaces of a generally rectangular piece of a resilient and compressible material, the springs lying in passageways through the thickness of the resilient material, which passageways have one dimension substantially equal to the diameter of the springs, and a dimension perpendicular thereto greater than that of the diameter of the springs, the material of the generally rectangular piece substantially filling the spaces between a majority of the springs, wherein to provide the required passageways through the resilient and compressible material, said material has an initial width less than that required, and is provided with a number of cuts or slots of a length greater than that of the spring diameters, and is transversely stretched to create oval passageways to receive the springs, of one (lateral) dimension equal to that of the spring diameters and a second (longitudinal) dimension greater than that of the spring diameters.

2. A body support arrangement comprising an array of springs extending between the upper and lower outer surfaces of a generally rectangular piece of a resilient and compressible material, the springs lying in passageways trough the thickness of the resilient material, which passageways have one dimension substantially equal to the diameter of the springs, and a dimension perpendicular thereto greater than that of the diameter of the springs, the material of the generally rectangular piece substantially fume the spaces between a majority of the springs, wherein the resilient and compressible material is in two layers, upper and lower, with co-operating passageways to receive the upper and lower ends of the springs, and the spaces between the springs being filled by separate pieces of the same or compatible resilient and compressible material, wherein to provide the required passageways through the resilient and compressible material, each upper and lower layer of resilient and compressible materials have an initial width less than that required, and are provided with a number of cuts or slots of a length greater than that of the spring diameters, and are transversely stretched to create oval passageways to receive the springs, of one (lateral) dimension equal to that of the spring diameters and a second (longitudinal) dimension greater than that of the spring diameters.

3. A body support arrangement as in claim 2, wherein with springs inserted in the passageways, the or each layer of resilient material is held with a required transverse dimension, with free spaces to opposite sides of the springs in the longitudinal direction.

4. A body support arrangement comprising an array of springs extending between the upper and lower outer surfaces of a generally rectangular piece of a resilient and compressible material, the springs lying in passageways through the thickness of the resilient material which passageways have one dimension substantially equal to the diameter of the springs, and a dimension perpendicular thereto greater than that of the diameter of the springs, the material of the generally rectangular piece substantially filling the spaces between a majority of the springs, wherein the passageways through the layer of resilient and compressible material are formed by cuts or slots, transversely stretched into oval holes to receive the springs.

5. A body support arrangement comprising an array of springs extending between the upper and lower outer surfaces of a generally rectangular piece of a resilient and compressible material, the springs lying in passageways through the thickness of the resilient material, which passageways have one dimension substantially equal to the diameter of the springs, and a dimension perpendicular thereto greater than that of the diameter of the springs, the material of the generally rectangular piece substantially filling the spaces between a majority of the springs, wherein the passageways through the layer of resilient and compressible material are formed by punched holes of narrow oval shape stretched into larger oval holes to receive the springs.

6. A body support arrangement comprising an array of springs extending between the upper and lower outer surfaces of a generally rectangular piece of a resilient and compressible material, the springs lying in passageways through the thickness of the resilient material, which passageways have one dimension substantially equal to the diameter of the springs, and a dimension perpendicular thereto greater than that of the diameter of the springs, the material of the generally rectangular piece substantially filling the spaces between a majority of the springs, wherein the resilient and compressible material is in two layers, upper and lower, with co-operating passageways to receive the upper and lower ends of the springs, and the spaces between the springs being filled by separate pieces of the same or compatible resilient and compressible material, wherein the co-operating passageways through each upper and lower layer of resilient and compressible material are formed by cuts or slots, transversely stretched into oval hales to receive the springs.

7. A body support arrangement comprising an array of springs extending between the upper and lower outer surfaces of a generally rectangular piece of a resilient and compressible material, the springs lying in passageways through the thickness of the resilient material, which passageways have one dimension substantially equal to the diameter of the springs, and a dimension perpendicular thereto greater than that of the diameter of the springs, the material of the generally rectangular piece substantially filling the spaces between a majority of the springs, wherein the resilient and compressible material is in two layers, upper and lower, with co-operating passageways to receive the upper and lower ends of the springs, and the spaces between the springs being filled by separate pieces of the same or compatible resilient and compressible material, wherein co-operating passageways are formed through each upper and lower layer of resilient and compressible material and funned by punched holes of narrow oval shape stretched into larger oval holes to receive the springs.

8. A body support arrangement comprising an array of springs extending between the upper and lower outer surfaces of a generally rectangular piece of a resilient and compressible material, the springs lying in passageways through the thickness of the resilient material which passageways have one dimension substantially equal to the diameter of the springs, and a dimension perpendicular thereto greater than that, of the diameter of the springs, the material of the generally rectangular piece substantially filling the spaces between a majority of the springs, wherein the resilient and compressible material is in two layers, upper and lower, with co-operating passageways to receive the upper and lower ends of the springs, and the spaces between the springs being filled by separate nieces of the same or compatible resilient and compressible material, wherein the springs are relatively conventional pocketed springs, but with alternate springs removed in each longitudinal row, and with retained springs in one longitudinal row offset in relation to retained springs in the immediately adjacent row.

9. A body support arrangement, characterised by an array of springs (15) extending between upper and lower surfaces of the support arrangement, in spaced relationship in the longitudinal and transverse directions, the spaces between at least some of the springs being filled with resilient and compressible material (20, 21), characterised in that the springs (15) are relatively conventional pocket springs, with alternate springs removed.

10. A body support arrangement characterised by an array of springs (15) extending between upper and lower surfaces of the support arrangement, in spaced relationship in the longitudinal and transverse directions, the spaces between at least some of the springs being filled with resilient and compressible material (20, 21), wherein the resilient and compressible material (20, 21) is foam rubber, and fabric (18) between the retained springs (15) cut to leave a centrally disposed tic (19).

11. A body support arrangement characterised by an array of springs (15) extending between upper and lower surfaces of the support arrangement in spaced relationship in the longitudinal and transverse directions, the spaces between at least some of the springs being filled with resilient and compressible material (20, 21), characterised in that upper and lower layers (20, 21) of resilient and compressible material are provided, each layer having a required degree of resilience and compressiblility, characterised in that each layer (20,21) of resilient and compressible material is formed as a pad of required initial width and length, with spaced slits (22), and whereby the pad can be pilled to a required width to cause the slits to open to become through holes into which the ends of the springs can be inserted.

* * * * *